United States Patent [19]

Digangi et al.

[11] Patent Number: 4,886,276

[45] Date of Patent: Dec. 12, 1989

[54] GOLF TEE PLATFORM DEVICE

[76] Inventors: Joseph A. Digangi, 427 Glendale St., Owatonna, Minn. 55060; Daron L. Call, Rte. 1, Box 167, Claremount, Minn. 55924

[21] Appl. No.: 244,509

[22] Filed: Sep. 14, 1988

[51] Int. Cl.[4] ..... A63B 69/36; A63B 57/00

[52] U.S. Cl. ..... 273/201; 273/195 A

[58] Field of Search ..... 273/201, 183 A, 195 R, 273/195 A, 195 B, 196, 197 R, 197 A, 198, 25, 176 F, 176 FA, 176 FB, 176 J, 176 G, 176 E, 33

[56] References Cited

U.S. PATENT DOCUMENTS

| | | | |
|---|---|---|---|
| 1,779,541 | 10/1930 | Haynes | 273/201 X |
| 2,127,282 | 8/1938 | Beckett | 273/201 |
| 2,198,968 | 4/1940 | Jewett | 273/201 |
| 3,639,923 | 2/1972 | Stewart | 273/195 B |
| 4,331,332 | 5/1982 | Hughes | 273/195 B |
| 4,355,811 | 10/1982 | Williams | 273/201 |
| 4,561,653 | 12/1985 | Wright | 273/25 |
| 4,662,641 | 5/1987 | Peyret | 273/201 |

*Primary Examiner*—George J. Marlo

*Attorney, Agent, or Firm*—Vidas & Arrett

[57] ABSTRACT

A golf practice device includes an elevated platform molded of plastic. The platform includes wooden load distributing members in depressed areas on either side of a central area for the ball. A ball lifting mechanism lifts a ball from a Y-pipe fed from a golf ball filled tube. A motor operates a cam which causes a tee holder to rise and fall within a grooved straight leg of the Y-pipe.

11 Claims, 10 Drawing Sheets

GOLF TEE PLATFORM DEVICE

BACKGROUND OF THE INVENTION

1. Field of the Invention

This invention relates to golf practice devices and more particularly to driving range platforms and mechanisms for providing a ball on a tee without requiring a change of stance.

2. Description of the related art.

Golf practice stations at golf courses and driving ranges typically will try to provide some sort of surface on which the golfer may stand and address the ball. On some of those devices, the golfer must manually place a ball on a tee while others supply a mechanism for putting balls on the tees.

U.S. Pat No. 4,331,332 to Hughes which issued May 25, 1982 is illustrative of prior golf practice stations. That platform is basically formed of wood and provides two mats 14 and 16. One mat supports a golfer and the other supports a tee. The tee is simply placed in to the mesh where desired.

Other driving ranges will simply fabricate elevated wooden platforms to keep the golfer out of the mud and dirt. Some platforms will also include a means for providing a golf ball to the golfer. U.S. Pat. No. 4,662,641 to Peyret, Jr. includes an apparatus which conveys a succession of golf balls in a linear path first in the address position. The linear path is provided by an elongated slot in a simulated golfing surface and an endless conveyor belt carries the balls along the path in a uniform rate of speed. The golfer must time his position.

None of the prior platforms known to the inventors are entirely suitable to the consuming public. The existing wooden platforms are typically built on site by 2×4's and nails. Mechanisms which currently supply golfer on a tee for the golfer either require the golfer to time their swing so as to hit the ball or require the golfer to change his stance so that another ball can be placed on top of a tee. The change of stance, of course, is undesirable since while practicing the golfer is attempting to vary only one variable at a time so that they may learn the effect of each golfing parameter which must be controlled.

SUMMARY OF THE INVENTION

The present invention provides a platform for supporting a standing golfer and a golf ball. The platform is molded of rigid plastic which is easy to manufacture and provides excellent weather resistance. Plastic is molded to include a recess in which a heat resistant load distributing member is positioned. This load distributing member is utilized to help distribute the load of the golfer on the platform since the molded plastic would otherwise tend to sag on a hot day if a load is not distributed across a larger surface than the shape of a shoe. The platform also includes an artificial turf carpet overlaying substantially the entire surface of the ball carrying surface and the load carrying surface of the load distributing member. The carpet surface simulates the resiliency of grass and provides a clean aesthetically pleasing surface.

The plastic platform is molded in one piece and includes corners and edges having an inside and outside radius of at least a quarter inch and preferably between about ½" and 1" in diameter. The rounded edges and corners provides the necessary structural strength to allow an adult golfer to stand on the platform without damaging the platform.

The platform may also include a mechanism which will supply a golf ball on a tee whenever a switch is touched by the golf club head. In such forms, the platform includes a side opening into which a golfer places a tube holding many golf balls. These golf balls are then able to feed by gravity into a Y-shaped tube. At the base of the Y-shaped tube, there is a flexible tee which is smoothly raised and lowered out of the Y-shaped tube by the operation of a motor. The motor is controlled by a switch which extends through the surface of the plastic platform near the area where the golf ball may project through the platform. In that manner, the golfer merely needs to touch the switch with the golf club head which causes the motor to rotate which in turn, through associated linkage mechanisms, causes the tee and a new ball to rise above the platform surface.

BRIEF DESCRIPTION OF THE DRAWINGS

A detailed description of one preferred embodiment of the invention is hereinafter described with specific reference being made in the drawings in which.

DESCRIPTION OF THE PREFERRED EMBODIMENT

Figure 1:
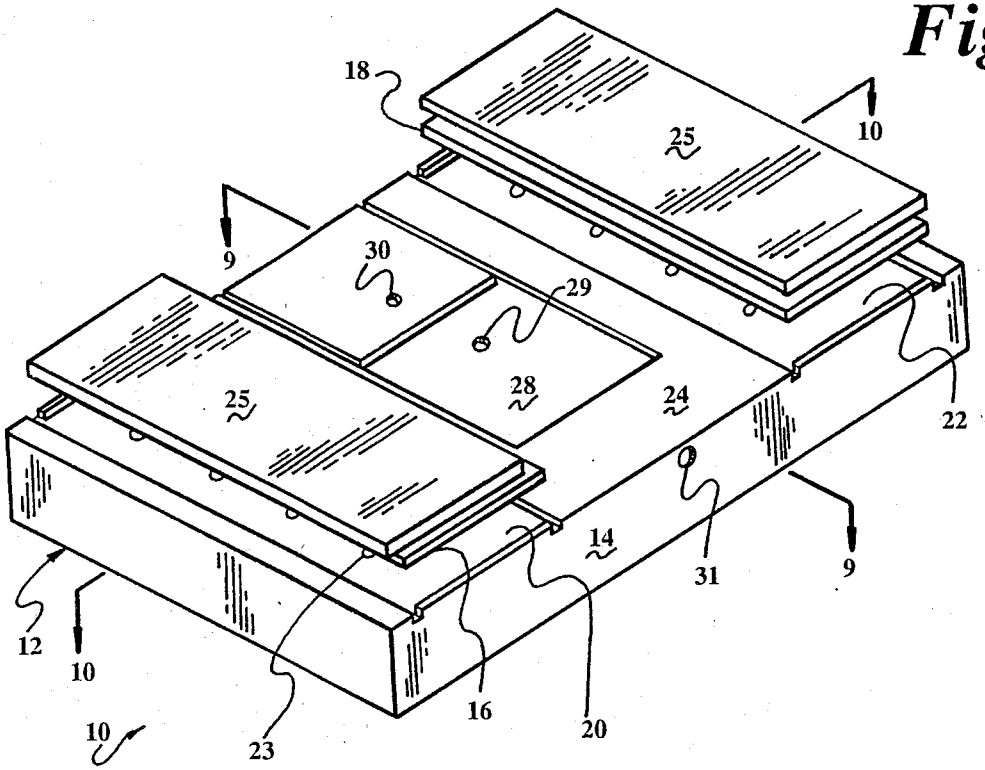
FIG. 1 is a perspective, partially exploded view of the golf platform of the invention.
Figure 2:
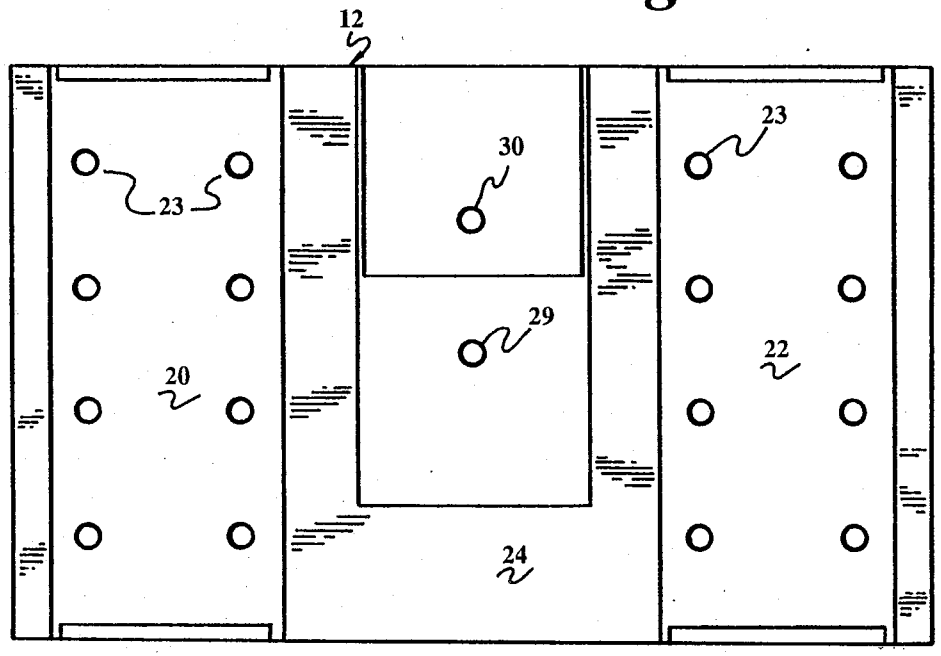
FIG. 2 is a top view of the platform of FIG. 1 showing the molded plastic portion only.

With reference to FIGS. 1 and 2, the device 10 of the invention includes a molded rigid plastic platform 12 which includes an upper surface and four sides 14. Device 10 also includes a pair of load distributing members 16 and 18.

Platform 12 is preferably formed from a medium density polyethylene and should include UV inhibitors since the platform will be in the sun when placed outdoors. Molded plastic platform 12 shown in FIG. 1 is designed to carry either a right handed golfer or left handed golfer. Accordingly, platform 12 is molded to include a depression 20 into which load distributing members 16 may be placed to carry the weight of a right handed golfer. Likewise, depression 22 will carry load distributing member 18 for left handed golfers. The depressions are formed to a depth that when the load distributing members are in place, the upper surfaces of the load distributing members will be substantially planer with upper surface 24 of plastic platform 12. As shown in FIG. 1, load distributing members 16, 18 are preferably covered with a carpet 25 to provide an attractive, non-slip surface.

Figure 8:
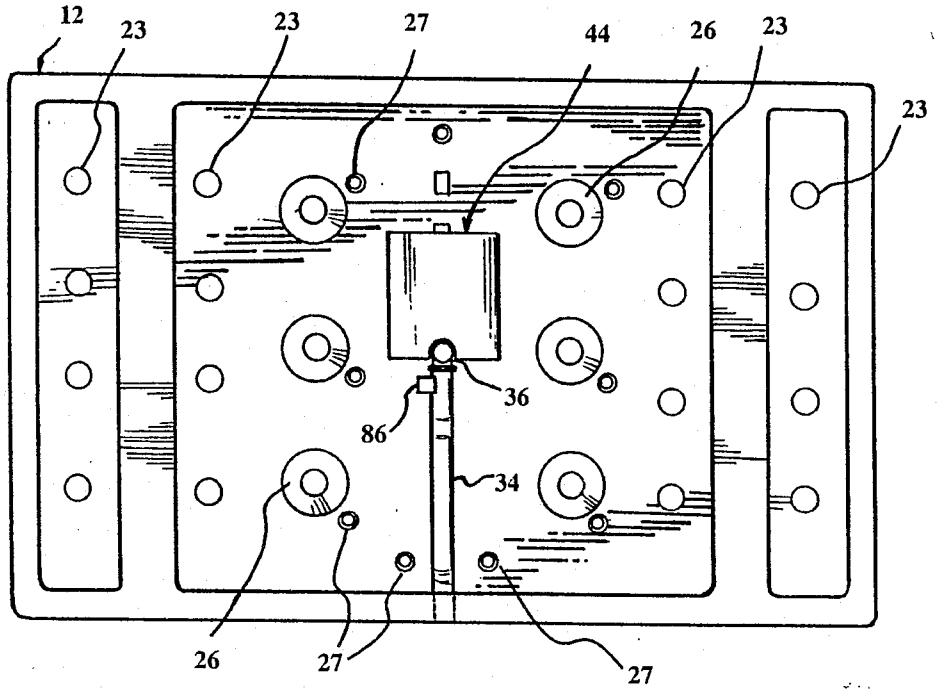
FIG. 8 is a bottom view of the device of the invention.

The underside of platform 12 as shown in FIG. 8 includes a plurality of support cones 26 evenly distributed to add strength to the platform. The use of kiss-offs 27, as well as the use of less plastic in forming the platform results in a lighter, more easily transported device. Molded drainage holes 23 add strength and provide drainage.

Platform 12 preferably includes three openings which extend completely through the plastic. Opening 29 is provided to allow the golf ball to pass up through opening 29 from the underside of the platform. An artificial turf covering 28 is placed around opening 29 as shown in FIG. 1. It is preferably a drilled hole of 2⅝ diameter. Opening 30 is spaced away from opening 29 and allows a switch mechanism to protrude therethrough which is readily accessible to the golfer by merely pressing the switch with a golf club. Finally, opening 31 is preferably provided if a mechanism is added to the platform for supplying a ball through an opening 29. The opening 31 is provided such that a golfer may place an initial supply of balls through opening 31 to be accessible to the golf ball teeing mechanism.

The platform in FIG. 1 is typically about 12" high. The overall length of the platform is typically on the order of about 8 feet with each of the load distributing members being about 4' apart. The width of the platform is typically between about 3' and 6' to allow for bearing positions of a golfer on the load distributing members. A suitable load distributing member may be formed from ¼ thick plywood.

Figure 3:
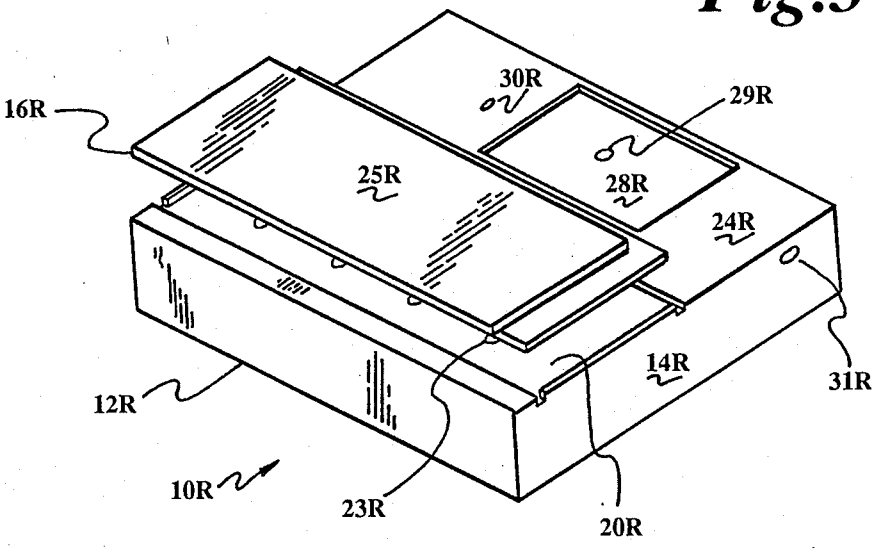
FIG. 3 is a perspective, partially exploded view of an alternative platform for right handed golfers.
Figure 4:
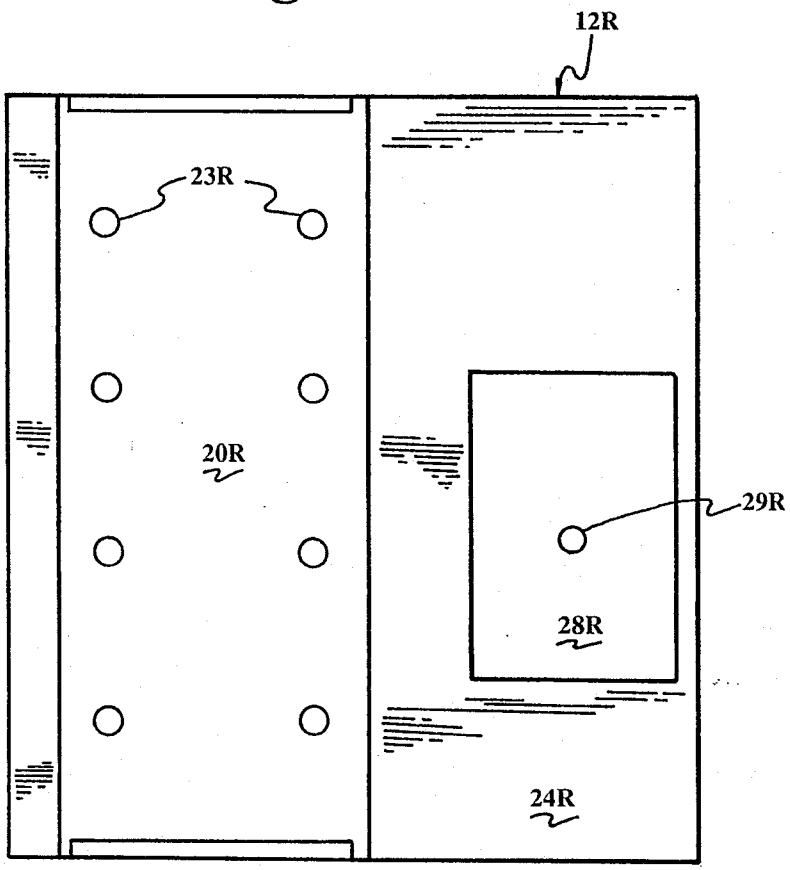
FIG. 4 is a top view of the platform of FIG. 3 which parts broken away.
Figure 5:
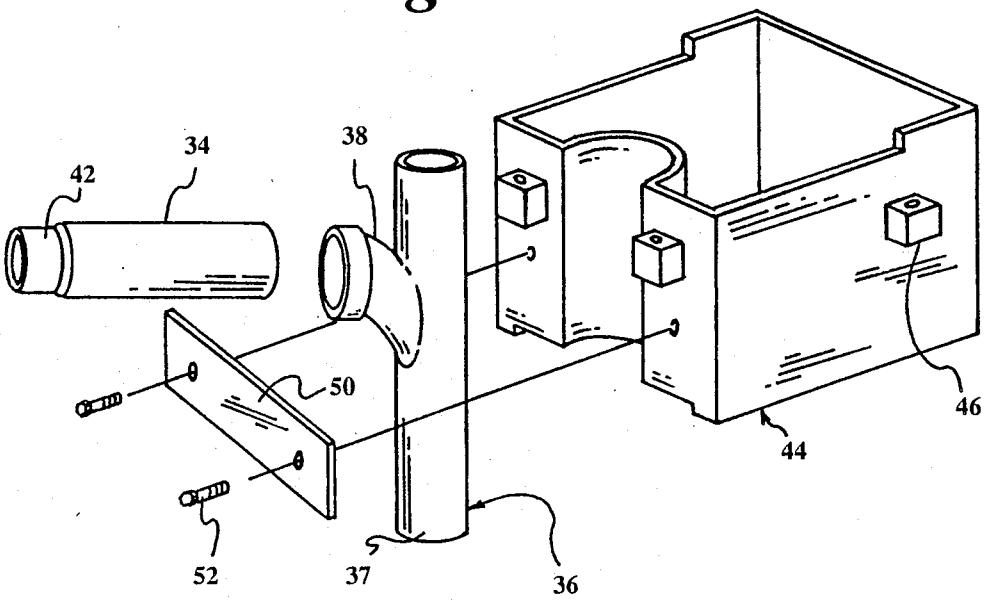
FIG. 5 is an exploded view of the golf ball supply mechanism of the invention.

FIGS. 3 and 4 show an alternative device of the invention which provides support for right-handed golfers only. Such forms, or a left-hand version, may be desirable for personal use of the golf device. Like reference numerals have been employed, with a suffix "r" used to denote right-hand version. Thus, for example, FIGS. 3 and 4 illustrate device **10*r* with platform 12*r*, load distributing member 16*r*** and so forth. Openings are shown through which a golf ball mechanism, as described later, may be utilized.

As shown in FIGS. 5–9, a golf ball mechanism may be installed to the underside of device 10. The mechanism includes a tube 34 which leads to a Y-pipe 36, which includes a straight section 37 and a curved leg 38. Curved leg 38 meets straight section 37 at a sharply defined intersection 39, seen in FIGS. 9A, B which functions to lessen the chance for a ball to re-enter curved leg 38. Section 37 enters leg 38 at about a 75 to 85 degree angle. Opposite leg 38, section 37 includes a groove 40 extending from near its bottom to near its top. Tube 34 is angled downwardly from opening 31 to leg 38. A ball tube 42 may be inserted into opening 31 to feed up to twenty-five balls to the ball lifting mechanism.

The lifting mechanism is housed within housing 44 which is attached to the underside of platform 12 at lugs 46. Y-pipe 36 is held to housing 44 by plate 50 and screws 52.

Figure 6:
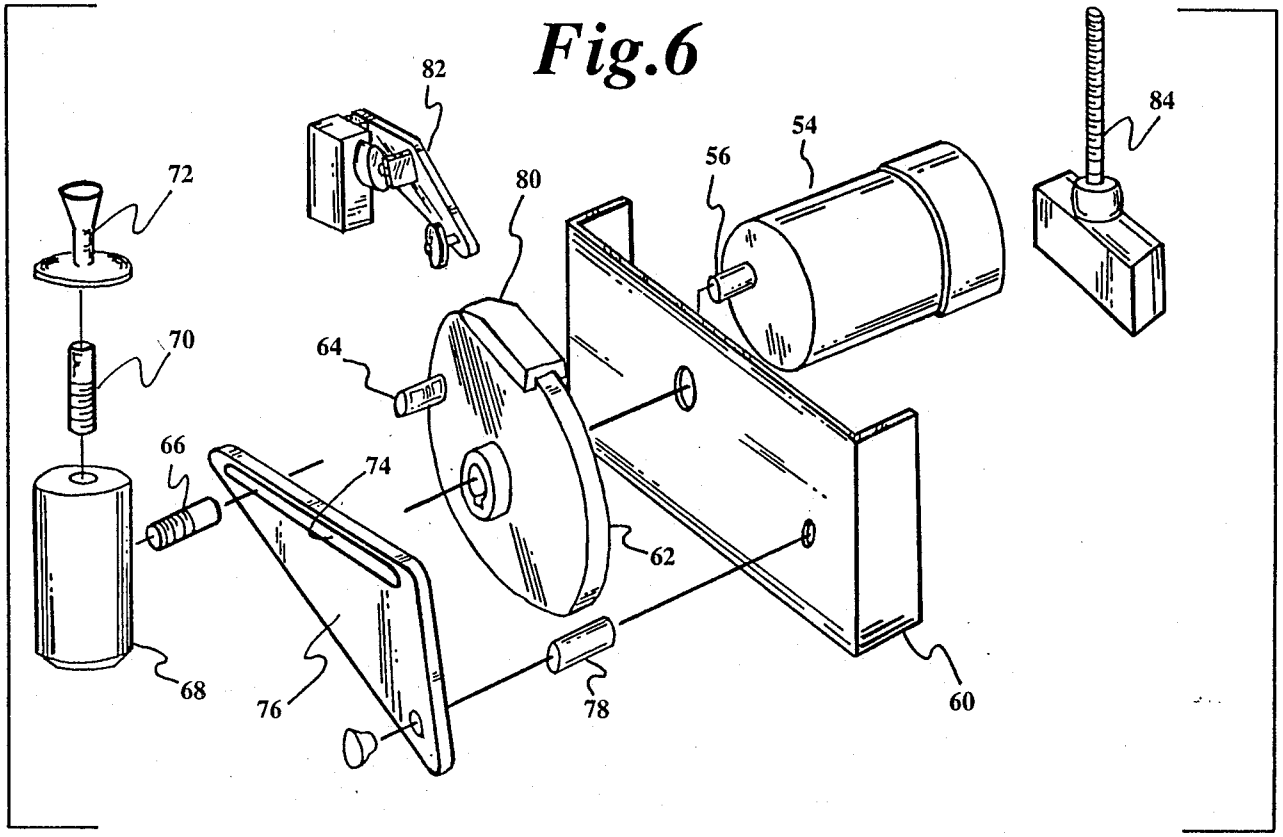
FIG. 6 is an exploded view of the golf ball lifting mechanism.
Figure 7:
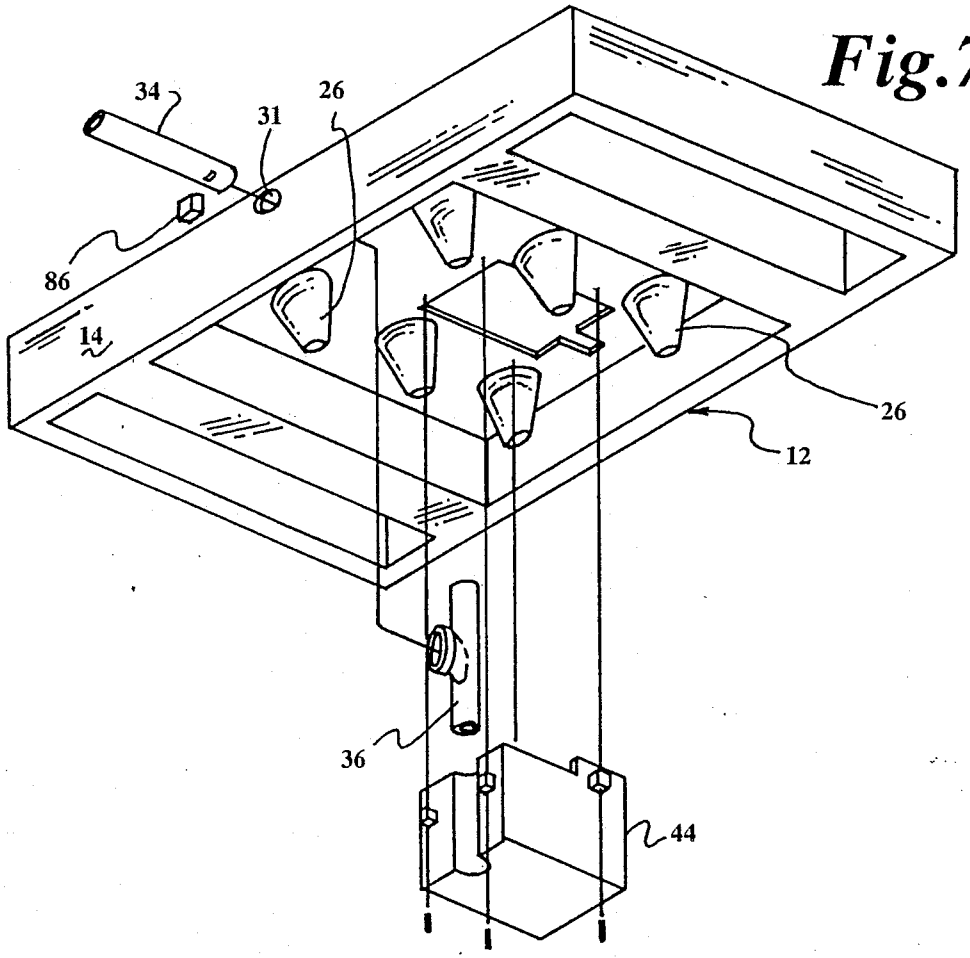
FIG. 7 is an exploded perspective view of the underside of the device of the invention.

As shown in FIGS. 6 and 9, a motor 54 having a shaft 56 is attached to plate 60 which is fixed to housing 44. A fan may be added to cool the motor if needed. A cam wheel 62 is attached to shaft 56 and includes a sleeve 64 which extends into slot 74 of lever 76. Lift rod 66 is rigidly attached to a tubular tee holder 68 which is placed inside Y-pipe 36. Rod 66 extends through groove 40. Tee holder 68 includes a member 70 which is attachable to a flexible rubber tee 72.

The free end of lift rod 66 also passes into slot 74 of lever 76. Lever 76 is pivotably mounted to plate 60 at pivot 78. As shaft 56 rotates, wheel 62 revolves causing sleeve 64 to move within slot 74, raising and lowering lever 76. As lever 76 moves, tee holder 68 moves up and down within Y-pipe 36 due to the lift rod 66 in slot 74.

Figure 9A:
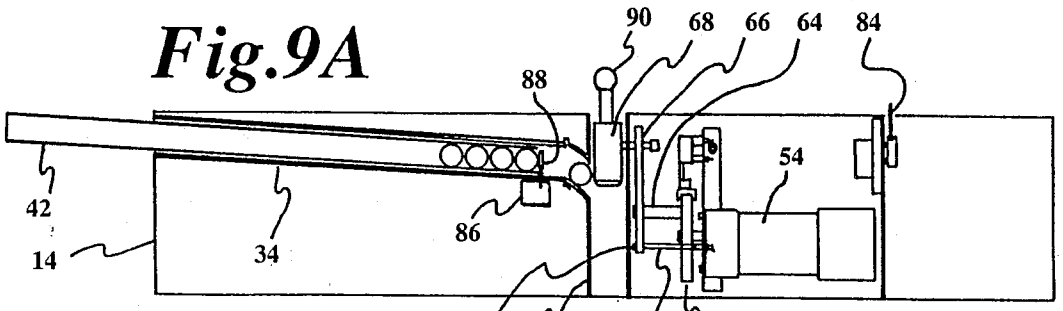
FIG. 9A is a sectional view of the device of FIG. 1 through lines 9—9 showing a ball in the ready position.
Figure 9B:
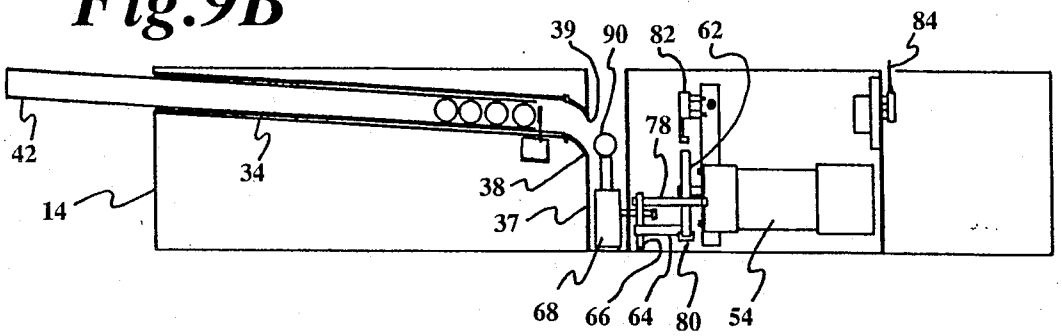
FIG. 9B is a view as in FIG. 9A, showing the ball in the lowest level.
Figure 10:
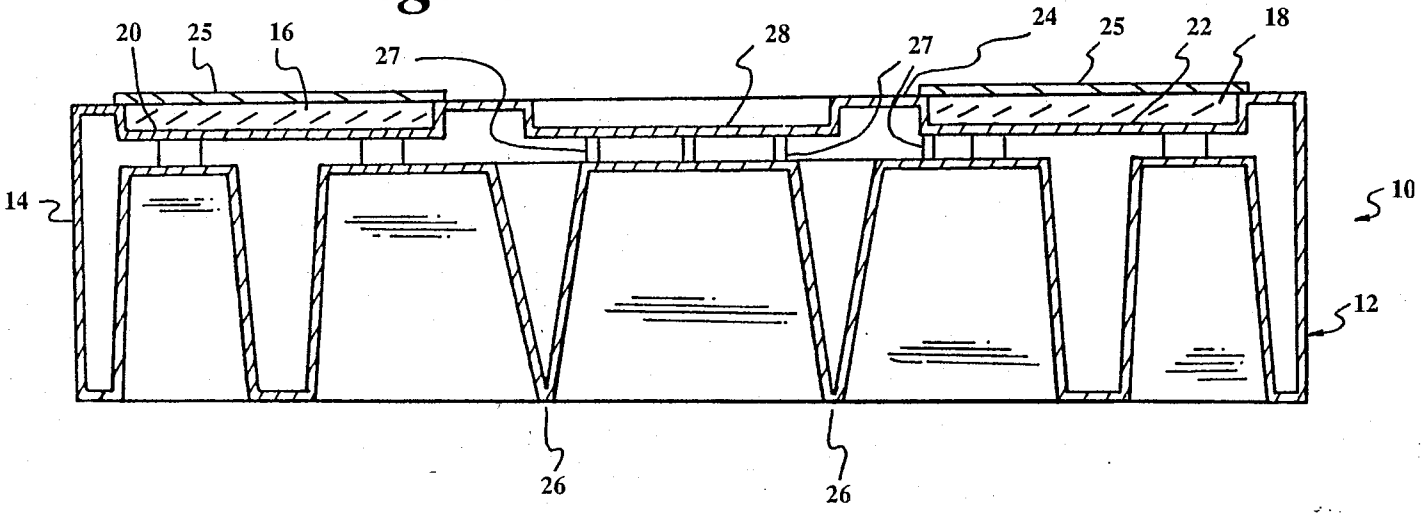
FIG. 10 is a cross-sectional view of the device of FIG. 1 through lines 10—10.

Wheel 62 includes an enlargement 80 which engages with microswitch 82 which turns motor 54 off. Motor 54 is energized by depression of spring switch 84 which extends through opening 30 in platform 12. Switch 84 is easily accessible to a golfer on the device and may be actuated with a golf club without breaking stance. Actuation of switch 84 also activates a solenoid 86 which has its core 88 extending through curved leg 38 as shown in FIGS. 9A and 9B. When energized, core 88 pulls down allowing a ball 90 to travel down into straight section 37. Only one ball at a time is released which decreases the pressure which would otherwise be applied to a tee holder 68 by many balls.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A device for supporting a standing golfer and a golf ball such that said golfer may address the ball, said device comprising:

(a) a generally rectangular, raised platform molded of a rigid plastic, said platform including a top and four sides, said top defining a ball carrying surface and a golfer carrying surface, said golfer carrying surface defining a plane which is parallel to, but lower than a plane defined by said ball carrying surface;

(b) a load distributing member substantially covering said golfer carrying surface and being attached thereto, said load distributing member being heat resistant and of a thickness such that when so positioned, the upper surface of the load distributing member will be substantially planar with said ball carrying surface; and (c) a covering of carpet overlaying the surface of said ball carrying surface and upper surface of said load distributing member.

2. The device of claim 1 wherein said load distributing member is constructed of wood to provide load distribution and resistance to heat deformation.

3. The device of claim 1 wherein said platform includes a plurality of spaced molded kiss-offs as stiffening members.

4. The device of claim 1 wherein all edges of said plastic platform between a pair of sides and a side and top have a radius of between about ¼" and 1".

5. A golf-practice device for supporting a standing golfer and a golf ball such that said golfer may address the ball from either a right handed or left-handed swing, said device comprising:

(a) a generally rectangular, raised platform molded of rigid plastic, said platform including a top and four sides, said top defining three separate zones, a central golf ball carrying zone and a right zone and a left zone on which either right handed or left-handed golfers, respectively, may stand, said right and left zones each defining planes parallel to but lower than a plane defined by said central ball carrying zone;

(b) load distributing members substantially covering said right and left zones and being attached thereto, said load distributing members being heat resistant and of a thickness such that when so positioned, the upper surfaces of said load distributing members will be substantially planer with an upper surface of said central ball carrying zones; and (c) a covering of carpet overlaying the surface of said golf ball carrying zone and the upper surface of said load distributing members.

6. The device of claim 5 wherein said load distributing member is constructed of wood to provide load distribution and resistance to heat deformation.

7. The device of claim 5 wherein said platform includes a plurality of spaced, molded kiss-offs as stiffening members.

8. The device of claim 5 wherein all edges of said plastic platform between a pair of sides and a side and top have a radius of between about ¼" and 1".

9. A mechanism for supplying golf balls on a tee through a hole in a golfing platform upon depression of a switch by a golfer, the mechanism comprising:

(a) a generally tee shaped tube having a straight leg and a tee leg angled from said straight leg; said tee leg entering said straight leg at an angle of about 75 to 85 degrees, each of said legs defining passageways through which a golf ball may readily pass, the intersection of said tee leg and said straight leg being toward the top of said straight leg when said straight leg is positioned vertically, when so positioned, the lower portion of said intersection having a smooth radius internally so as to allow a ball to move from said tee leg to said straight leg and the upper portion of said intersection having a downwardly projecting member to direct balls down into said straight leg said straight leg being constructed and arranged so as to define a groove opposite said tee leg extending along the length of said straight leg between the ends of said straight leg;

(b) means for raising and lowering a flexible tee within said straight leg comprising a tee holder which extends through said groove in said straight leg and which is slidably mounted to a lever member, said lever member being linked to a lift rod on a cam driven by a motor which when rotated by said motor causes said tee holder to rise and fall within said straight leg, and (c) means for remotely operating said motor including a switch which may be actuated a golfer so as to cause the cam to cycle down to allow a ball to be deposited in said tee and to cycle up to its highest point presenting a ball on said tee above the top of said straight leg.

10. The device of claim 9 further including a ball supply tube which may be connected to said tee leg to supply balls to said flexible tee.

11. An automatic golf driving range device for supplying golf balls on a tee and for supporting a golfer, said device comprising:

(a) a generally rectangular, raised platform molded of a rigid plastic, said platform including a top and four sides, said top defining a ball carrying surface and a golfer carrying surface, said golfer carrying surface defining a plane which is parallel to, but lower than a plane defined by said ball carrying surface;

(b) a load distributing member substantially covering said golfer carrying surface and being attached thereto, said load distributing member being heat resistant and of a thickness such that when so positioned, the upper surface of the load distributing member will be substantially planar with said ball carrying surface;

(c) a covering of carpet overlaying the surface of said ball carrying surface and upper surface of said load distributing member; and (d) means for supplying golf balls on a tee through a hole in said ball carrying surface, said means including a generally tee shaped tube having a straight leg and a tee leg angled from said straight leg; said tee leg entering said straight leg at an angle of about 75 to 85 degrees, each of said legs defining passageways through which a golf ball may readily pass, the intersection of said tee leg and said straight leg being toward the top of said straight leg when said straight leg is positioned vertically, when so positioned, the lower portion of said intersection having a smooth radius internally so as to allow a ball to move from said tee leg to said straight leg and the upper portion of said intersection having a downwardly projecting member to direct balls down into said straight leg said straight leg being constructed and arranged so as to define a groove opposite said tee leg extending along the length of said straight leg between the ends of said straight leg; means for raising and lowering a flexible tee within said straight leg comprising a tee holder which extends through said groove in said straight leg and which is slidably mounted to a lever member, said lever member being linked to a lift rod on a cam driven by a motor which when rotated by said motor causes said tee holder to rise and fall within said straight leg, and means for remotely operating said motor including a switch which may be actuated by a golfer so as to cause the cam to cycle down to allow a ball to be deposited in said tee and to cycle up to its highest point presenting a ball on said tee above the top of said straight leg.

* * * * *